US010266933B2

(12) United States Patent
Nasserrafi et al.

(10) Patent No.: US 10,266,933 B2
(45) **Date of Patent: *Apr. 23, 2019**

(54) ALUMINUM-COPPER ALLOYS WITH IMPROVED STRENGTH

(71) Applicant: Spirit AeroSystems, Inc., Wichita, KS (US)

(72) Inventors: Rahbar Nasserrafi, Andover, KS (US); David E. Jakstis, Andover, KS (US); Gerald E. Hicks, Wichita, KS (US); Darrell Wade, Wichita, KS (US)

(73) Assignee: SPIRIT AEROSYSTEMS, INC., Wichita, KS (US)

( * ) Notice: Subject to any disclaimer, the term of this patent is extended or adjusted under 35 U.S.C. 154(b) by 948 days.

This patent is subject to a terminal disclaimer.

(21) Appl. No.: 14/011,320

(22) Filed: Aug. 27, 2013

(65) Prior Publication Data

US 2016/0047022 A1 Feb. 18, 2016

Related U.S. Application Data

(60) Provisional application No. 61/693,454, filed on Aug. 27, 2012.

(51) Int. Cl.
*C22F 1/057* (2006.01)
*C22C 21/16* (2006.01)
(Continued)

(52) U.S. Cl.
CPC ..... *C22F 1/057* (2013.01); *C22C 21/12* (2013.01); *C22C 21/16* (2013.01); *C22C 21/18* (2013.01); *C22F 1/002* (2013.01)

(58) Field of Classification Search
CPC ..... C22C 21/12; C22C 21/16; C22C 21/18; C22F 1/057
See application file for complete search history.

(56) References Cited

U.S. PATENT DOCUMENTS 2,506,788 A * 5/1950 Hobbs ..... C22C 21/10 148/417
2,784,126 A * 3/1957 Criner ..... C22C 21/12 148/418
(Continued)

FOREIGN PATENT DOCUMENTS

CA FR 2954355 A1 * 6/2011 ..... B22D 21/007
CH 298572 7/1954
(Continued)

OTHER PUBLICATIONS

R.B.C. Cayless, Alloy and Temper Designation Systems for Aluminum and Aluminum Alloys, Properties and Selection: Nonferrous Alloys and Special Purpose Materials, vol. 2, ASM Handbook, ASM International, 1990, p. 15-28.*
(Continued)

*Primary Examiner* — George Wyszomierski
*Assistant Examiner* — Janell C Morillo
(74) *Attorney, Agent, or Firm* — Hovey Williams LLP

(57) ABSTRACT

Aluminum alloys are provided that can comprise boron and vanadium and high amounts of titanium and zirconium. The aluminum alloys described herein can exhibit superior tensile properties at both room temperature and elevated temperatures and still maintain desirable ductility. The aluminum alloys can be used in applications where resistance to fatigue and breakdown at elevated temperatures is desirable, which includes applications in the aerospace and aeronautical fields.

26 Claims, 3 Drawing Sheets

(51) Int. Cl.

| | |
|---|---|
| ***C22F 1/00*** | (2006.01) |
| ***C22C 21/18*** | (2006.01) |
| ***C22C 21/12*** | (2006.01) |

(56) References Cited

U.S. PATENT DOCUMENTS

| | | | | |
|---|---|---|---|---|
| 4,772,342 | A | 9/1988 | Polmear | |
| 5,055,256 | A | 10/1991 | Sigworth et al. | |
| 5,115,770 | A | 5/1992 | Yen et al. | |
| 5,259,897 | A * | 11/1993 | Pickens | C22C 21/12 148/417 |
| 5,376,192 | A | 12/1994 | Cassada, III | |
| 5,455,003 | A | 10/1995 | Pickens et al. | |
| 5,512,112 | A | 4/1996 | Cassada, III | |
| 5,597,529 | A | 1/1997 | Tack | |
| 5,620,652 | A | 4/1997 | Tack et al. | |
| 5,630,889 | A | 5/1997 | Karabin | |
| 5,652,063 | A | 7/1997 | Karabin | |
| 5,665,306 | A | 9/1997 | Karabin | |
| 5,738,735 | A | 4/1998 | Bechet | |
| 5,759,302 | A | 6/1998 | Nakai et al. | |
| 6,126,898 | A * | 10/2000 | Butler | C22C 32/0073 420/529 |
| 6,368,427 | B1 | 4/2002 | Sigworth | |
| 6,579,386 | B1 | 6/2003 | Bjorkman, Jr. et al. | |
| 6,592,687 | B1 | 7/2003 | Lee et al. | |
| 6,969,432 | B2 | 11/2005 | Raynaud et al. | |
| 7,177,387 | B2 | 2/2007 | Yasunaga et al. | |
| 7,229,508 | B2 | 6/2007 | Cho et al. | |
| 7,323,068 | B2 | 1/2008 | Benedictus et al. | |
| 7,547,366 | B2 | 6/2009 | Lin et al. | |
| 8,043,445 | B2 * | 10/2011 | Benedictus | C22F 1/057 148/417 |
| 8,133,331 | B2 * | 3/2012 | Langan | C22C 21/06 148/415 |
| 2006/0137783 | A1 | 6/2006 | Aruga et al. | |
| 2006/0157172 | A1 | 7/2006 | Fischer et al. | |
| 2006/0269437 | A1 | 11/2006 | Pandey | |
| 2008/0029187 | A1 * | 2/2008 | Lin | C22C 1/06 148/417 |
| 2008/0305354 | A1 | 12/2008 | Lee et al. | |
| 2009/0260723 | A1 | 10/2009 | Pandey | |
| 2010/0089502 | A1 | 4/2010 | Zhuang et al. | |
| 2010/0139815 | A1 | 6/2010 | Pandey | |
| 2010/0143177 | A1 | 6/2010 | Pandey | |
| 2011/0030856 | A1 | 2/2011 | Warner et al. | |
| 2011/0176957 | A1 | 7/2011 | Che et al. | |
| 2012/0258010 | A1 * | 10/2012 | Garat | B22D 21/007 420/535 |

FOREIGN PATENT DOCUMENTS

| | | |
|---|---|---|
| EP | 1249303 | 10/2002 |
| WO | 199405820 | 3/1994 |

OTHER PUBLICATIONS

Davis, J.R. "Aluminum and Aluminum Alloys" ASM Specialty Handbook, 1993.

MIL-HDBK-1265 Aug. 19, 1998 (Radiographic Classification handbook for DoD).

www.aircraftspruce.com/catalog/mepages/aluminfo.php (Accessed Aug. 2011).

* cited by examiner

ALUMINUM-COPPER ALLOYS WITH IMPROVED STRENGTH

RELATED APPLICATIONS

This application claims the priority benefit under 35 U.S.C. § 119(e) of U.S. Provisional Patent Application Ser. No. 61/693,454 entitled "ALUMINUM-COPPER ALLOY WITH IMPROVED STRENGTH AT ROOM TEMPERATURE AND ELEVATED TEMPERATURES," filed Aug. 27, 2012, the entire disclosure of which is incorporated herein by reference.

BACKGROUND

1. Field of the Invention

The present invention is generally related to aluminum alloys and articles produced therefrom. More particularly, the present invention is related to aluminum-copper alloys exhibiting improved strength at room temperature and elevated temperatures.

2. Description of the Related Art

Aluminum alloys have long been used in the aerospace field due to their unique combination of strength and lightweight. However, the new generations of jet engines are becoming more efficient and generally run hotter than their predecessors. Therefore, titanium is increasingly being utilized more often for aerospace applications since conventional aluminum alloys do not generally provide sufficient strengths at the elevated operating temperatures of the newer jet engines.

Although there are many commercially available aluminum alloys that can be used in a variety of fields, many of these alloys have limited applications in the aerospace field due to their inability to exhibit ideal strengths at both room temperatures and the elevated operating temperatures of jet engines. For example, the 7000-series aluminum alloys generally exhibit high strength up to about 275° F., but quickly lose their strength at higher temperatures. In contrast, the 2000-series aluminum alloys typically exhibit higher strengths at elevated temperatures than the 7000-series, but exhibit lower strengths at room temperature and are prone to stress corrosion cracking.

U.S. Pat. Nos. 4,772,342; 5,055,256; 5,115,770; 5,259,897; 5,455,003; 5,512,112; 5,630,889; 5,665,306; 6,126,898; 6,368,427; 6,579,386; and 7,229,508; and U.S. Patent Application Publication Nos. 2006/0137783; 2011/0030856; and 2011/0176957, each of which are incorporated herein by reference in their entireties, describe various aluminum alloys containing different types of alloying additives. Although the various aluminum alloys described in these references may exhibit desirable traits sought in specific types of aluminum alloys, each exhibit at least one deficiency that do not make them ideal fir use in aerospace applications.

Accordingly, there is a need for an aluminum alloy for aerospace and aeronautical applications that exhibits a desirable strength portfolio at both room temperature and the elevated operating temperatures of jet engines.

SUMMARY

One or more embodiments of the present invention concern an aluminum alloy. The aluminum alloy comprises aluminum, at least 3.5 and up to 6.5 weight percent of copper; titanium; boron; and zirconium. The Ti/B ratio in the alloy is in the range of 1 and 10, while the Zr/Ti ratio is in the range of 0.1 to 10.

One or more embodiments of the present invention concern a wrought aluminum alloy. The wrought aluminum alloy comprises at least about 40 and up to about 99 weight percent of aluminum; at least about 0.5 and up to about 20 weight percent of copper; at least about 0.2 and up to about 10 weight percent of magnesium; and at least about 0.02 and up to about 2 weight percent of boron.

One or more embodiments of the present invention concern a method for producing an aluminum alloy. The method comprises (a) heat treating an initial aluminum alloy to thereby provide a heat-treated aluminum alloy; (b) quenching the heat-treated aluminum alloy to thereby provide a quenched aluminum alloy; (c) working the quenched aluminum alloy to thereby provide a worked aluminum alloy; and (d) aging the worked aluminum alloy to thereby provide the aluminum alloy. The aluminum alloy comprises at least about 40 and up to about 99 weight percent of aluminum; at least about 0.5 and up to about 20 weight percent of copper; at least about 0.2 and up to about 10 weight percent of magnesium; and at least about 0.02 and up to about 2 weight percent of boron.

BRIEF DESCRIPTION OF THE FIGURES

Embodiments of the present invention are described herein with reference to the following figures, wherein.

DETAILED DESCRIPTION

Figure 1:
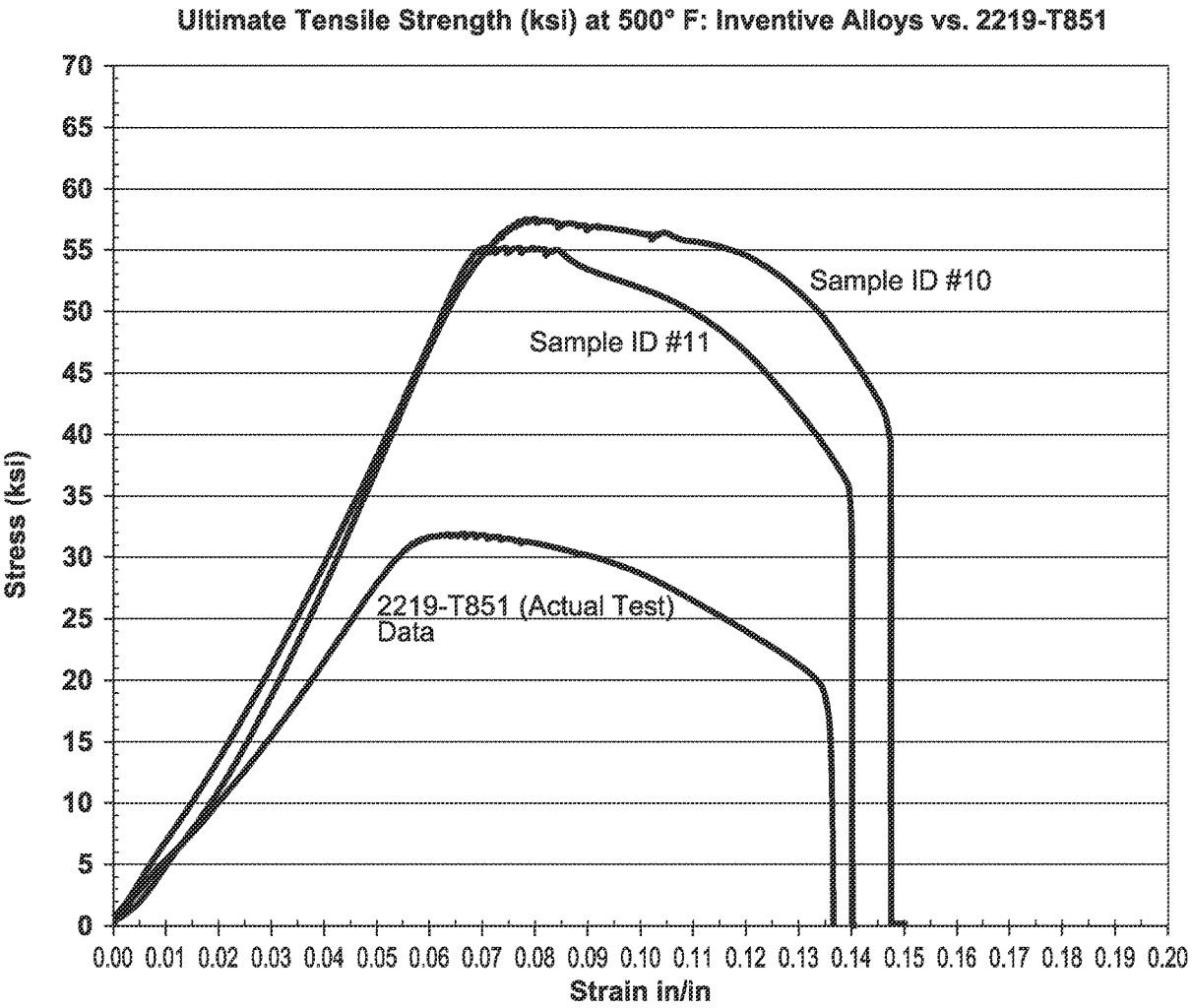
FIG. 1 is a graph depicting the differences in ultimate tensile strength at 500° F. between the aluminum alloys described herein and 2219-T851.

The present invention is generally directed to aluminum alloys that exhibit high strength at both room temperature and elevated temperatures. This is in contrast to many aluminum alloys currently used in the industry, especially conventional 2000-series and 7000-series aluminum alloys. Unlike conventional aluminum alloys, the aluminum alloys described herein can exhibit superior strengths at both room temperature and elevated temperatures. By offering elevated strength at both room temperatures and elevated temperatures, the aluminum alloys described herein can be utilized in those applications that have recently begun incorporating titanium. Thus, by using the aluminum alloys described herein, the material and manufacturing costs typically associated with the use and fabrication of titanium can be avoided.

The amount of aluminum in the aluminum alloys can vary depending on the number and amounts of alloying elements added to the alloy. In various embodiments, the aluminum alloys can comprise at least about 40, 70, or 80 and/or up to about 99, 95, or 90 weight percent of aluminum. More particularly, the aluminum alloys can comprise in the range of about 40 to 99, 70 to 95, or 80 to 90 weight percent of aluminum.

As one skilled in the art would readily appreciate, the aluminum may comprise incidental impurities. As used herein, "incidental impurities" refer to any impurities that naturally occur in the aluminum ore used to the produce the aluminum alloys or that are inadvertently added during the production process. The aluminum alloys can comprise less than about 0.1, 0.05, or 0.001 weight percent of the incidental impurities.

The aluminum alloys described herein can contain one or more alloying elements. In various embodiments, the aluminum alloys can be substantially free from alloying elements which are known to form coarse and incoherent dispersoids and second phase particle constituents. Rather, the aluminum alloys can contain alloying elements that provide coherent or semi-coherent dispersoids, along with densely distributed precipitation hardening elements. As used herein, the terms "practically free" and "substantially free" mean that the alloy comprises less than 0.001 weight percent of the relevant component. Furthermore, the terms "practically free" and "substantially free" may be used interchangeably.

In various embodiments, the aluminum alloys can comprise copper. The presence of copper in the aluminum alloys can provide substantial increases in strength and can facilitate precipitation hardening. The introduction of copper can also reduce ductility and corrosion resistance. The aluminum alloy can comprise, for example, at least about 0.5, 1.5, 3.5, 3.9, or 5.2 and/or up to about 20, 10, 7, 6.5, or 5.8 weight percent of copper. More particularly, the aluminum alloy can comprise in the range of about 0.5 to 20, 1.5 to 10, 3.5 to 7, 3.5 to 6.5, or 5.2 to 5.8 weight percent of copper.

In various embodiments, the aluminum alloys can comprise boron. It has been observed that the presence of boron in the aluminum alloys can be correlated with significant increases in the tensile strengths of the alloys. The aluminum alloys can comprise, for example, at least about 0.02, 0.04, 0.06, or 0.08 and/or up to about 5, 2, 0.5, or 0.25 weight percent of boron. More particularly, the aluminum alloys can comprise in the range of about 0.02 to 5, 0.0.4 to 2, 0.02 to 0.5, 0.06 to 0.5, or 0.08 to 0.25 weight percent of boron.

In various embodiments, the aluminum alloys can comprise magnesium. The addition of magnesium to the aluminum alloys can increase the strength of the alloy through solid solution strengthening and can also improve the strain hardening ability of the alloy. The aluminum alloy can comprise, for example, at least about 0.2, 0.4, 0.6, or 0.7 and/or up to about 10, 5, 2, or 1 weight percent of magnesium. More particularly, the aluminum alloys can comprise in the range of about 0.2 to 10, 0.4 to 5, 0.2 to 2, 0.6 to 2, or 0.7 to 1 weight percent of magnesium.

In various embodiments, the aluminum alloys can comprise manganese. The addition of manganese to the aluminum alloy can increase the tensile strength of the alloy and also improve strain hardening while not appreciably reducing ductility or corrosion resistance. The aluminum alloy can comprise, for example, at least about 0.2, 0.3, or 0.35 and/or up to about 5, 1, or 0.6 weight percent of manganese. More particularly, the aluminum alloys can comprise in the range of about 0.2 to 5, 0.3 to 1, or 0.35 to 0.6 weight percent of manganese.

In various embodiments, the aluminum alloys can comprise zinc. The addition of zinc to the aluminum alloy, especially in conjunction with magnesium and/or copper, can produce heat-treatable aluminum alloys having a very high tensile strength. The zinc can substantially increase strength and can permit precipitation hardening of the alloy. The aluminum alloy can comprise, for example, at least about 0.1, 0.2, 0.5, or 0.7 and/or up to about 5, 3, 1.5, or 1 weight percent of zinc. More particularly, the aluminum alloy can comprise in the range of about 0.1 to 5, 0.2 to 3, 0.5 to 1.5, or 0.7 to 1 weight percent of zinc.

Furthermore, the zinc can mitigate problems generally associated with higher copper and magnesium contents in the aluminum alloy. Thus, in various embodiments, the content of copper, magnesium, and zinc in the aluminum alloy can be based on the formula: Cu+Mg−Zn, which can be maintained in the range of about 2 to 10, 3 to 8, or 4 to 6.5 weight percent. Similarly, the aluminum alloys can have a ratio of magnesium to zinc (Mg/Zn) in the range of about 0.1 to 12, 0.5 to 5, or 1 to 3.

In various embodiments, the aluminum alloys can comprise titanium. Titanium has been typically added to aluminum alloys to function as a grain refiner. The aluminum alloy can comprise, for example, at least about 0.1, 0.2, or 0.25 and/or up to about 3, 1.5, or 0.9 weight percent of titanium. More particularly, the aluminum alloy can comprise in the range of about 0.1 to 3, 0.2 to 1.5, 0.1 to 0.9, or 0.25 to 0.9 weight percent of titanium.

Furthermore, the grain refining effect of titanium can be enhanced if boron is present in the melt. Thus, in various embodiments, the aluminum alloys can have a titanium to boron (Ti/B) ratio in the range of 1 to 10, 1.5 to 7, or 2 to 4.

In various embodiments, the aluminum alloys can comprise zirconium. Zirconium can facilitate the formation of fine precipitates of intermetallic particles in the aluminum alloys that can inhibit recrystallization. The aluminum alloys can comprise, for example, at least about 0.05, 0.1, or 0.13 and/or up to about 3, 0.9, or 0.6 weight percent of zirconium. More particularly, the aluminum alloys can comprise in the range of about 0.05 to 3, 0.1 to 0.9, or 0.13 to 0.6 weight percent of zirconium.

It was also observed that the sum and ratio of boron, titanium, and zirconium could affect the strength of the alloys. Thus, in various embodiments, the amount of boron, titanium, and zirconium in the aluminum alloys can be based on the formula: (Ti+Zr)/B, which can be maintained in the range of about 1 to 10, or 2 to 8, or 3 to 6 weight percent. Similarly, the aluminum alloys can have a zirconium to titanium (Zr/Ti) ratio in the range of about 0.1 to about 10, 0.3 to 7, or 0.5 to 4.

In various embodiments, the aluminum alloys can comprise vanadium. It was observed that vanadium can have synergetic effects with titanium and boron and can increase the tensile strength of the aluminum alloys. The aluminum alloys can comprise, for example, at least about 0.005, 0.01, or 0.05 and/or up to about 5, 1, or 0.25 weight percent of vanadium. More particularly, the aluminum alloys can comprise in the range of about 0.005 to 5, 0.01 to 1, or 0.05 to 0.25 weight percent of vanadium. Furthermore, in various embodiments, the amount of vanadium, titanium, and zirconium in the aluminum alloys can be based on the formula: Ti+Zr+V, which can be maintained in the range of about 0.01 to 10, 1 to 5, or 0.18 to 1.5 weight percent. In such embodiments, one or more transitional elements can replace up to about 0.2 weight percent of the titanium, zirconium, or vanadium in the formula.

In various embodiments, the aluminum alloys can optionally comprise chromium. Chromium can be added to aluminum to control grain structure and to prevent recrystallization during heat treatment. Chromium can also reduce stress corrosion susceptibility and improve toughness. The aluminum alloy can comprise, for example, at least about 0.001, 0.005, or 0.01 and/or up to about 0.5, 0.2, or 0.1 weight percent of chromium. More particularly, the aluminum alloy can comprise in the range of about 0.001 to 0.5, 0.005 to 0.2, or 0.02 to 0.1 weight percent of chromium.

In various embodiments, the aluminum alloys can optionally comprise nickel. Nickel can be added to aluminum alloys to improve hardness and strength at elevated temperatures and to reduce the coefficient of expansion. The aluminum alloys can comprise, for example, at least about 0.05, 0.1, or 0.3 and/or up to about 1.2, 0.8, or 0.5 weight percent of nickel. More particularly, the aluminum alloy can comprise in the range of about 0.05 to 1.2, 0.1 to 0.8, or 0.3 to 0.5 weight percent of nickel.

In various embodiments, the aluminum alloys can optionally comprise cobalt. The aluminum alloys can comprise, for example, at least about 0.05, 0.1, or 0.3 and/or up to about 1.2, 0.8, or 0.5 weight percent of cobalt. More particularly, the aluminum alloy can comprise in the range of about 0.05 to 1.2, 0.1 to 0.8, or 0.3 to 0.5 weight percent of cobalt. Furthermore, cobalt and nickel can have a synergetic effect with one another. Thus, in various embodiments, the amount of cobalt and nickel in the aluminum alloy can be based on the formula: Co+Ni, which can be maintained in the range of about 0.05 to 1.2, 0.1 to 0.8, or 0.3 to 0.5 weight percent.

In various embodiments, the aluminum alloys can optionally comprise scandium. The addition of scandium to aluminum alloys can create nanoscale $Al_3Sc$ precipitates that limit excessive grain growth. The aluminum alloy can comprise, for example, at least about 0.01, 0.05, or 0.1 and/or up to about 0.5, 0.35, or 0.25 weight percent of scandium. More particularly, the aluminum alloy can comprise in the range of about 0.01 to 0.5, 0.05 to 0.35, or 0.1 to 0.25 weight percent of scandium.

In various embodiments, the aluminum alloys can comprise silver. The aluminum alloys can comprise, for example, at least about 0.1, 0.2, or 0.25 and/or up to about 1, 0.75, or 0.5 weight percent of silver. More particularly, the aluminum alloys can comprise in the range of about 0.1 to 1, 0.2 to 0.75, or 0.25 to 0.5 weight percent of silver.

In various embodiments, the aluminum alloys can optionally comprise strontium. The aluminum alloys can comprise, for example, at least about 0.001, 0.005, or 0.01 and/or up to about 0.5, 0.2, or 0.09 weight percent of strontium. More particularly, the aluminum alloy comprises in the range of about 0.001 to 0.5, 0.005 to 0.2, or 0.01 to 0.09 weight percent of strontium.

In various embodiments, the aluminum alloys can optionally comprise beryllium. The aluminum alloys can comprise, for example, at least about 0.0001, 0.001, or 0.005 and/or up to about 0.1, 0.05, or 0.009 weight percent of beryllium. More particularly, the aluminum alloys can comprise in the range of about 0.0001 to 0.1, 0.001 to 0.05, or 0.005 to 0.009 weight percent of beryllium.

In various embodiments, the aluminum alloys can optionally comprise calcium. The aluminum alloys can comprise, for example, at least about 0.001, 0.005, or 0.01 and/or up to about 0.5, 0.1, or 0.05 weight percent of calcium. More particularly, the aluminum alloys can comprise in the range of about 0.001 to 0.5, 0.005 to 0.1, or 0.01 to 0.05 weight percent of calcium.

In various embodiments, the aluminum alloys can be practically free of iron, silicon, lithium, antimony, and/or rare earth elements. It is also possible that the aluminum alloys can comprise one of these alloying elements, but be substantially free of any one of the others.

It should be noted that the aluminum alloys can comprise any of the above alloying elements in any combination and that any of the above alloying elements can be used without having to exclude another alloying element.

Exemplary compositional ranges for the various alloying elements are provided in TABLE 1 below. Unless stated otherwise, all composition values herein are in weight percent.

TABLE 1

Exemplary Compositional Ranges of Alloying Elements (Weight %)

| Alloying Element | Broad | Intermediate | Narrow |
|---|---|---|---|
| Cu | 0.5 to 20 | 3.5 to 10 | 5.2 to 5.8 |
| B | 0.02 to 5 | 0.02 to 0.5 | 0.08 to 0.25 |
| Mg | 0.2 to 10 | 0.4 to 5 | 0.7 to 1.0 |
| Mn | 0.2 to 5 | 0.3 to 1 | 0.35 to 0.6 |
| Zn | 0.1 to 5 | 0.5 to 1.5 | 0.7 to 1.0 |
| (Cu + Mg − Zn) | 2 to 10 | 3 to 8 | 4 to 6.5 |
| Mg/Zn | 0.1 to 12 | 0.5 to 5 | 1 to 3 |
| Ti | 0.1 to 3 | 0.2 to 1.5 | 0.25 to 0.9 |
| Zr | 0.05 to 3 | 0.1 to 0.9 | 0.13 to 0.6 |
| V | 0.005 to 5 | 0.01 to 1 | 0.05 to 0.25 |
| (Ti + Zr + V) | 0.01 to 10 | 1 to 5 | 0.18 to 1.5 |
| Zr/Ti | 0.1 to 10 | 0.3 to 7 | 0.5 to 4 |
| (Ti + Zr)/B | 1 to 10 | 2 to 8 | 3 to 6 |
| Ni | Up to 1.2 | 0.1 to 0.8 | 0.3 to 0.5 |
| Co | Up to 1.2 | 0.1 to 0.8 | 0.3 to 0.5 |
| Co + Ni | Up to 1.2 | 0.1 to 0.8 | 0.3 to 0.5 |
| Cr | Up to 0.5 | 0.005 to 0.2 | 0.02 to 0.1 |
| Sc | Up to 0.5 | 0.05 to 0.35 | 0.1 to 0.25 |
| Ag | 0.1 to 1 | 0.2 to 0.75 | 0.25 to 0.5 |
| Sr | Up to 0.5 | 0.005 to 0.2 | 0.01 to 0.09 |
| Be | Up to 0.1 | 0.001 to 0.05 | 0.005 to 0.009 |
| Ca | Up to 0.5 | 0.005 to 0.1 | 0.01 to 0.05 |

As noted above, the aluminum alloys described herein can exhibit desirable tensile properties that can be applicable in a wide variety of applications.

In various embodiments, the aluminum alloys can exhibit desirable ductile properties. Percent elongation measures the ductility of the aluminum alloy by measuring the strain at fracture in tension. The aluminum alloys can comprise, for example, a percent elongation of at least about 2, 4, or 5 and/or up to about 40, 20, or 15 percent as measured according to ASTM E8. More particularly, the aluminum alloys can have a percent elongation in the range of about 2 to 40, 4 to 20, or 5 to 15 percent as measured according to ASTM E8.

The aluminum alloys described herein can also exhibit high offset yield strengths. Offset yield strength measures the stress at which yielding of the aluminum alloy begins depending on the sensitivity of the strain measurements. The aluminum alloys can exhibit, for example, an offset yield strength at room temperature of at least about 40, 60, or 75 and/or up to about 200, 150, or 100 ksi as measured according to ASTM E8. More particularly, the aluminum alloys can exhibit an offset yield strength at room temperature in the range of about 40 to 200, 60 to 150, or 75 to 100 ksi as measured according to ASTM E8.

The aluminum alloys described herein can also exhibit high ultimate tensile strengths at room temperature. Ultimate tensile strength ("UTS"), often shortened to tensile strength ("TS") or ultimate strength, is the maximum stress that a material can withstand while being stretched or pulled before failing or breaking. The aluminum alloys can exhibit, for example, an ultimate tensile strength at room temperature of at least about 50, 65, or 80 and/or up to about 200, 150, or 100 ksi as measured according to ASTM E8. More particularly, the aluminum alloys can exhibit an ultimate tensile strength at room temperature in the range of about 50 to 200, 65 to 150, or 80 to 100 ksi as measured according to ASTM E8.

Furthermore, the aluminum alloys described herein can exhibit high ultimate tensile strengths at elevated temperatures. For instance, after being subjected to a temperature of about 500° F. for about 30 minutes, the aluminum alloys can exhibit an ultimate tensile strength of at least about 35, 45, or 50 and/or up to about 150, 100, or 65 ksi as measured according to ASTM E8. More particularly, the aluminum alloy can have an ultimate tensile strength after prolonged exposure at 500° F. in the range of about 35 to 150, 45 to 100, or 50 to 65 ksi as measured according to ASTM E8. In one or more embodiments, the ultimate tensile strength of the aluminum alloy at room temperature is up to about 50, 40, or 35 percent greater than the ultimate tensile strength of the alloy after being subjected to a temperature of about 500° F. for about 30 minutes.

The aluminum alloys, after being subjected to a temperature of about 450° F. for about 30 minutes, can exhibit an ultimate tensile strength of at least about 40, 50, or 60 and/or up to about 150, 100, or 70 ksi as measured according to ASTM E8. More particularly, the aluminum alloy can have an ultimate tensile strength after prolonged exposure at 150° F. in the range of about 40 to 150, 50 to 100, or 60 to 70 ksi as measured according to ASTM E8.

The aluminum alloys, after being subjected to a temperature of about 400° F. for about 30 minutes, can exhibit an ultimate tensile strength of at least about 40, 50, or 60 and/or up to about 150, 100, or 75 ksi as measured according to ASTM E8. More particularly, the aluminum alloy can have an ultimate tensile strength after prolonged exposure at 100° F. in the range of about 40 to 150, 50 to 100, or 60 to 75 ksi as measured according to ASTM E8.

The aluminum alloys, after being subjected to a temperature of about 350° F. for about 30 minutes, can exhibit an ultimate tensile strength of at least about 40, 55, or 65 and/or up to about 150, 100, or 80 ksi as measured according to ASTM E8. More particularly, the aluminum alloy can have an ultimate tensile strength after prolonged exposure at 350° F. in the range of about 40 to 150, 55 to 100, or 65 to 80 ksi as measured according to ASTM E8.

Unless indicated otherwise, the aluminum alloys described herein can be prepared by:

(a) heat treating an initial aluminum alloy to thereby provide a heat-treated aluminum alloy;

(b) quenching the heat-treated aluminum alloy to thereby provide a quenched aluminum alloy;

(c) working the quenched aluminum alloy to thereby provide a worked aluminum alloy; and (d) aging the worked aluminum alloy to thereby provide the aluminum alloy.

The heat treating step can comprise a solution heat treatment. Solution heat treatment generally comprises soaking an alloy at a sufficiently high temperature and for a long enough time to achieve a near homogeneous solid solution of precipitate-forming elements within the alloy. The objective is generally to take into solid solution the most practical amount of soluble-hardening elements. The extent to which an aluminum alloy's strength can be enhanced by heat treatment varies with the type and amount of alloying elements present. The heat treating step can occur at a temperature in the range of 850 to 1,000° F. and over a time period of 30 minutes to 48 hours, 1 hour to 12 hours, or about 1.5 hours.

The quenching step, or rapid cooling of the solid solution formed during solution heat treatment, can produce a supersaturated solid solution at room temperature. Generally, the quenching step comprises contacting the heat-treated aluminum alloy with water that is maintained at a temperature in the range of about 35 to 100, 50 to 95, or 70 to 90° F.

The working step can comprise stretching, forging, rolling, and/or spin-forming the aluminum alloy. Working of the alloys can be carried out at room temperature or at warmer temperatures. In various embodiments, the working comprises stretching the aluminum alloy at room temperature. In such embodiments, the aluminum alloy can be stretched by at least about 1%, 2%, or 4% and/or up to about 15%, 10%, or 8%.

The aging step can form strengthening precipitates in the aluminum alloy. Such precipitates may be formed naturally at ambient temperatures or artificially using elevated temperature aging techniques. In natural aging, the quenched aluminum alloys can be held at temperatures ranging from −5 to 120° F. In artificial aging, a quenched alloy can be held at temperatures typically ranging from 200 to 375° F. The aging step may occur over a time period of 5 to 48, 7 to 24, or 12 to 17 hours.

It should be noted that, in various embodiments, the order of the above steps can be reversed as necessary. In other words, in certain embodiments, the quenched aluminum alloys can be aged prior to being worked.

The initial aluminum alloy subjected to the above steps can be produced using any conventional method known in the art. For example, the initial aluminum alloy can be produced from casting an aluminum ore with one or more alloy additives comprising the above alloying elements. Such casting methods can occur, for example, at a temperature in the range of 1,150 to 1,450° F.

In various embodiments, the aluminum alloy described herein can be a wrought alloy. As used herein, "wrought" refers to alloys which have been subjected to mechanical working.

The aluminum alloys described herein can be used in any product where a combination of high strength and lightweight is desirable. In particular, the aluminum alloys described herein may be utilized in applications that require fatigue and damage tolerance. In various embodiments, the aluminum alloys can be utilized in the aeronautical and aerospace fields. Aerospace applications include, for example, propulsion components and under-wing components used for commercial aircraft. The aluminum alloys can also be used in automotive components including, for example, wheels, piston engine blocks, drive shafts, frames, and other components that operate above 350° F. Other possible products that could contain the aluminum alloys described herein include, for example, cooking utensils, radiator components, air conditioning condensers, evaporators, heat exchangers, piping, wires, pressure vessels, framing, furniture, and baseball bats.

This invention can be further illustrated by the following examples of embodiments thereof, although it will be understood that these examples are included merely for the purposes of illustration and are not intended to limit the scope of the invention unless otherwise specifically indicated.

EXAMPLES

Examples 1-12

For these examples, various tensile properties were measured in conventional aluminum alloys (Comparative Examples 1-8) and the inventive aluminum alloys described herein (Examples 9-12). All samples were produced by subjecting the initial alloys to solution treatment at a temperature of 950° F. (+/−25° F.) for about 1.5 hours. After solution treatment, the samples were quenched in water at a temperature of 70 to 90° F. The samples were then subsequently stretched to 4% (+/−2%) and aged at a temperature of about 325° F. (+/−10° F.) for 16 hours.

The offset yield strength ("YS"), ultimate tensile strength ("UTS"), and percent elongation ("% El") of the samples were measured and are depicted in TABLE 2 below. Comparative Examples 11-8 demonstrate the effects that copper, magnesium, titanium, zirconium, scandium, and cobalt can have on the aluminum alloys.

TABLE 2

| | ID | Cu | Mn | Mg | Ag | Zn | Ti | B | Zr | V | Sc | Co | Li | YS | UTS | % El |
|---|---|---|---|---|---|---|---|---|---|---|---|---|---|---|---|---|
| Comparative | 1 | 5.8 | — | 0.5 | 0.5 | — | 0.18 | — | 0.08 | — | 0.26 | — | — | 59.1 | 63.2 | 10.7 |
| | 2 | 5.5 | — | 0.5 | 0.5 | — | 0.17 | — | 0.07 | — | 0.26 | — | — | 57.4 | 61.5 | 12.7 |
| | 3 | 5.8 | — | 0.8 | 0.5 | — | 0.17 | — | 0.12 | — | 0.27 | — | — | 63.3 | 67.8 | 11 |
| | 4 | 5.5 | — | 0.8 | 0.5 | 0.9 | 0.17 | — | 0.07 | — | 0.26 | — | — | 70.9 | 74.1 | 10.8 |
| | 5 | 5.5 | — | 0.5 | 0.5 | 0.9 | 0.19 | — | 0.06 | — | 0.3 | — | — | 55.6 | 59.8 | 11.0 |
| | 6 | 5.7 | — | 0.5 | 0.5 | — | 0.20 | — | 0.07 | — | — | 0.3 | — | 54.6 | 58.4 | 9.3 |
| | 7 | 5.4 | — | 0.8 | 0.6 | — | 0.19 | — | — | — | — | 0.3 | — | 68.5 | 70.7 | 8.9 |
| | 8 | 5.7 | — | 0.8 | 0.6 | — | 0.17 | — | — | 0.16 | — | — | — | 62.1 | 66 | 10.4 |
| Inventive | 9 | 5.5 | — | 0.8 | 0.3 | 0.8 | 0.27 | 0.09 | 0.14 | 0.08 | 0.11 | — | — | 81.5 | 83.3 | 7.4 |
| | 10 | 5.7 | 0.38 | 0.8 | 0.3 | 0.8 | 0.38 | 0.14 | 0.43 | 0.09 | 0.1 | — | — | 79.9 | 82.7 | 10.0 |
| | 11 | 5.3 | 0.52 | 0.8 | 0.3 | 0.8 | 0.27 | 0.12 | 0.15 | 0.08 | — | 0.4 | — | 79.2 | 81.9 | 8.5 |
| | 12 | 5.5 | 0.5 | 0.8 | 0.4 | 0.8 | 0.6 | 0.2 | 0.5 | 0.1 | — | 0.4 | — | 85.3 | 87.9 | 6.4 |

As shown in TABLE 2, the inventive aluminum alloys (Examples 9-12) exhibited superior offset yield strengths and ultimate tensile strengths compared to the conventional aluminum alloys (Comparative Examples 1-8). Furthermore, the inventive aluminum alloys were able to maintain a desirable ductility (percent elongation) even though the offset yield strength and ultimate tensile strength of these alloys greatly increased. It appears that this unique combination of offset yield strength, ultimate tensile strength, and ductility in Examples 9-12 can be attributed, at least in part, to the presence of boron and vanadium and the increased levels of titanium and zirconium.

Additional tensile properties of Examples 9-12 were measured at various temperatures, including room temperature and various elevated temperatures (350° F., 400° F., 450° F., and 500° F.) as shown in TABLE 3. The ultimate tensile strength measurements at these elevated temperatures were conducted after exposing the aluminum alloy to the elevated temperature for about 30 minutes. In addition, similar tensile measurements were conducted on Comparative Examples 3, 4, and 7 and a Series-2000 aluminum alloy (2219-T851 from ALCOA). In many cases, as shown below in TABLE 3, some measurements were repeated on separate alloy samples and the average of these values was taken to obtain the average value for the respective property. Finally, surface quality tests were conducted on all of the samples. The surface quality test involved casting and extruding the samples into 1.5"×4" bars. The surface quality of the bars were rated from A (excellent) to F (terrible).

TABLE 3

| | 2nd Generation Spirit Aluminum Alloys | | | | Current | 1st Generation Spirit Alloys | | |
|---|---|---|---|---|---|---|---|---|
| Alloy | Sample ID 9 | Sample ID 11 | Sample ID 10 | Sample ID 12 | Standard 2219-T851 | Sample ID 3 | Sample ID 4 | Sample ID 7 |
| UTS at Room Temperature ("RT") | 83.3 | 84.6 | 83.0 | 89.7 | 68.0 | 71.4 | 73.0 | 70.8 |
| UTS at RT | 84.8 | 79.8 | 84.3 | 86.6 | 67.9 | 64.2 | 75.2 | 70.6 |
| UTS at RT | 84.8 | 80.1 | 82.5 | 90.0 | 66.2 | 64.9 | 74.1 | 72.5 |
| UTS at RT | 82.4 | 84.3 | 82.6 | 87.3 | 66.6 | — | 73.3 | — |
| UTS at RT | 83.9 | 81.6 | 82.3 | 86.2 | 65.3 | — | — | — |
| UTS at RT | 84.9 | 82.7 | 83.5 | — | — | — | — | — |
| UTS at RT | 82.9 | 81.5 | 80.4 | — | — | — | — | — |
| UTS at RT | 83.4 | 80.8 | 83.0 | — | — | — | — | — |
| Average UTS at RT | 83.8 | 81.9 | 82.7 | 88.0 | 66.8 | 67.8 | 74.1 | 71.3 |
| UTS (RT) % increase vs. 2219-T851 | 25% | 23% | 24% | 32% | — | 2% | 11% | 6% |
| YS at RT | 81.4 | 80.6 | 79.8 | 86.3 | 53.8 | 67.2 | 70.0 | 68.5 |
| YS at RT | 82.4 | 77.6 | 81.6 | 85.7 | 53.7 | 61.2 | 71.4 | 68.4 |
| YS at RT | 82.5 | 76.8 | 79.1 | 88.5 | 50.8 | 61.6 | 67.0 | 70 |
| YS at RT | 78.2 | 79.8 | 77.2 | 84.8 | 53.3 | — | 70.5 | 66.9 |
| YS at RT | 82.0 | 80.1 | 80.3 | — | 52.3 | — | 70.0 | — |
| YS at RT | 82.8 | 80.9 | 81.0 | — | — | — | — | — |
| YS at RT | 81.4 | 78.8 | 80.6 | — | — | — | — | — |
| Average YS | 81.5 | 79.2 | 79.9 | 86.3 | 52.8 | 63.3 | 69.8 | 68.5 |
| YS % increase vs. 2219-T851 | 54% | 50% | 51% | 64% | — | 20% | 32% | 30% |
| % Elongation | 7.5% | 8.7% | 10.4% | 6.6% | 11.5% | 11.3% | 11.8% | 7.3% |

TABLE 3-continued

| | 2nd Generation Spirit Aluminum Alloys | | | | Current | 1st Generation Spirit Alloys | | |
|---|---|---|---|---|---|---|---|---|
| Alloy | Sample ID 9 | Sample ID 11 | Sample ID 10 | Sample ID 12 | Standard 2219-T851 | Sample ID 3 | Sample ID 4 | Sample ID 7 |
| % Elongation | 6.5% | 6.6% | 8.7% | 4.8% | 10.5% | 10.0% | 10.4% | 7.9% |
| % Elongation | 7.1% | 8.8% | 10.8% | 5.9% | 10.0% | 11.6% | 10.4% | 9.0% |
| % Elongation | 8.1% | 9.4% | 9.9% | 7.7% | 10.6% | — | 9.7% | 11.6% |
| % Elongation | 7.0% | 8.0% | 9.9% | — | 6.7% | — | 11.8% | — |
| % Elongation | 6.9% | 7.6% | 9.1% | — | — | — | — | — |
| % Elongation | 9.0% | 10.1% | 10.8% | — | — | — | — | — |
| Average % Elongation | 7.4% | 8.5% | 10.0% | 6.3% | 10.6% | 11.0% | 10.6% | 8.9% |
| UTS at 500° F. | 53.6 | 55.3 | 57.6 | — | 34.3 | 45.4 | — | 51.2 |
| UTS at 500° F. | 53.1 | 53.4 | 55.7 | — | 32.0 | 47.1 | — | 53.5 |
| Average UTS at 500° F. | 53.4 | 54.3 | 56.7 | — | 33.1 | 46.3 | — | 52.4 |
| UTS at 450° F. | 64.7 | 60.7 | 62.2 | — | 37.2 | — | — | — |
| UTS at 400° F. | 61.2 | 64.2 | 62.7 | — | 44.9 | — | — | — |
| UTS at 350° F. | 71.3 | 70.4 | 69.5 | — | 51.7 | — | — | — |
| UTS (500° F.) increase vs. 2219-T851 | 61% | 64% | 71% | — | — | 40% | — | 58% |
| Surface Quality | A+ | A+ | B | D | C | A | A | B |

As shown in TABLE 3, the aluminum alloys in Examples 9-12 exhibited superior tensile strengths at both room temperature and elevated temperatures compared to Comparative Examples 3, 4, and 7 and 2219-T851. Furthermore, the aluminum alloys in Examples 9-11 still exhibited desirable surface qualities and maintained desirable ductility (percent elongation) properties in addition to their higher tensile strengths. FIG. 1 depicts the differences in ultimate tensile strength at 500° F. between the alloys of Examples 10 and 11 and 2219-T851. As shown in FIG. 1, the inventive samples contained a significantly higher tensile strength at 500° F. compared to 2219-T851.

The tensile properties of the aluminum alloys in Examples 9-12 were also compared to two separate Series-7000 aluminum alloys (7050-T74 and 7075-T7351, available from ALCOA). The results of these comparisons are depicted in TABLE 4 below. Relevant tensile measurements from the Series-2000 aluminum alloy noted above (2219-T851) are also included in TABLE 4.

TABLE 4

| Alloy | YS (ksi) | UTS (ksi) | % Elong | UTS @ 500 F. | Source |
|---|---|---|---|---|---|
| Sample ID 9 | 81.5 | 83.8 | 7.4 | 53.4 | Inventive |
| Sample ID 10 | 79.2 | 81.9 | 8.5 | 57.6 | Alloys |
| Sample ID 11 | 79.9 | 82.7 | 10.0 | 55.3 | |
| Sample ID 12 | 86.3 | 88.0 | 6.3 | — | |
| 2219 - T851 | 53.8 | 68.0 | 10.5 | 33.2 | Series-2000 |
| 7050-T74 | 65.3 | 74.0 | 13.0 | — | Series-7000 |
| 7075 - T7351 | 63.1 | 73.3 | 13.0 | 18.9 | |

Figure 2:
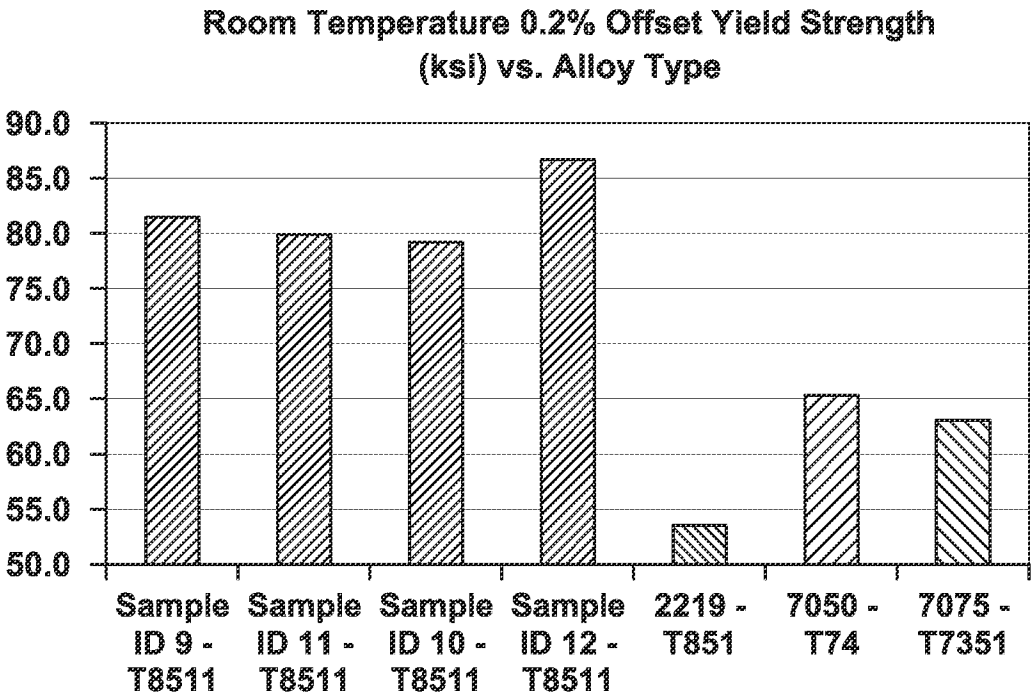
FIG. 2 is a graph depicting the difference in offset yield strengths between the aluminum alloys described herein and conventional Series-2000 and Series-7000 aluminum alloys.
Figure 3:
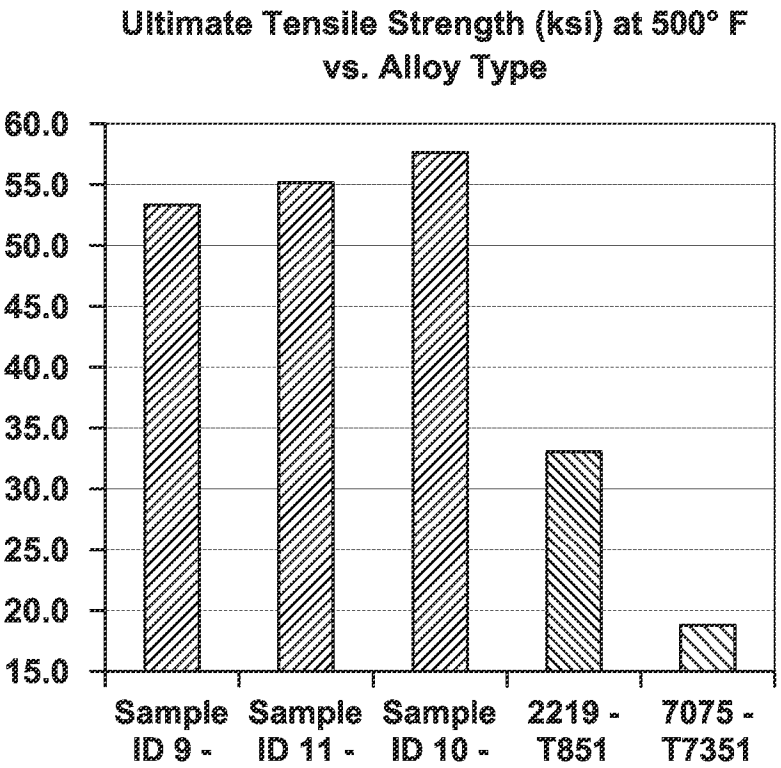
FIG. 3 is a graph depicting the difference in ultimate tensile strength at 500° F. between the aluminum alloys described herein and conventional Series-2000 and Series-7000 aluminum alloys.

As shown in TABLE 4, the alloys in Examples 9-12 exhibited superior offset yield strengths and ultimate tensile strengths compared to the Series-2000 and Series-7000 aluminum alloys. This includes superior ultimate tensile strengths at elevated temperatures. FIG. 2 depicts the difference in offset yield strengths between the alloys in Examples 9-12, 2219-T851, 7050-T74, and 7075-T7351. As depicted in FIG. 2, the alloys in Examples 9-12 exhibited significantly higher offset yield strengths at room temperature compared to the conventional Series-2000 and Series-7000 aluminum alloys. FIG. 3 depicts the difference in ultimate tensile strengths between the alloys in Examples 9-11, 2219-T851, and 7075-T7351. As shown in FIG. 3, the alloys in Examples 9-11 exhibited significantly higher tensile strengths at 500° F. compared to 2219-T851 and 7075-T7351.

The above detailed description of embodiments of the invention is intended to describe aspects of the invention in sufficient detail to enable those skilled in the art to practice the invention. Other embodiments can be utilized and changes can be made without departing from the scope of the invention. The above detailed description is, therefore, not to be taken in a limiting sense. The scope of the present invention is defined only by claims presented in subsequent regular utility applications, along with the full scope of equivalents to which such claims are entitled.

In this description, references to "one embodiment," "an embodiment," or "embodiments" mean that the feature or features being referred to are included in at least one embodiment of the technology. Separate references to "one embodiment", "an embodiment", or "embodiments" in this description do not necessarily refer to the same embodiment and are also not mutually exclusive unless so stated and/or except as will be readily apparent to those skilled in the art from the description. For example, a feature, step, etc. described in one embodiment may also be included in other embodiments, but is not necessarily included. Thus, the present technology can include a variety of combinations and/or integrations of the embodiments described herein.

The inventors hereby state their intent to rely on the Doctrine of Equivalents to determine and assess the reasonably fair scope of the present invention as it pertains to any apparatus not materially departing from but outside the literal scope of the invention as set forth in the following claims.

DEFINITIONS

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," and "have" have the same open-ended meaning as "comprising," "comprises," and "comprise" provided above.

As used herein, the terms "including," "include," and "included" have the same open-ended meaning as "comprising," "comprises," and "comprise" provided above.'

As used herein, the term "about" means that the associated values can vary by 10 percent from the recited value.

NUMERICAL RANGES

The present description uses numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 10 to 100 provides literal support for a claim reciting "greater than 10" (with no upper bounds) and a claim reciting "less than 100" (with no lower bounds).

What is claimed is:

1. An aluminum alloy, the aluminum alloy comprising:
aluminum;
at least 3.5 and up to 6.5 weight percent of copper;
at least 0.25 and up to about 3 weight percent of titanium;
at least 0.08 and up to about 1 weight percent of vanadium;
at least 0.5 and up to about 3 weight percent of zinc;
at least 0.4 weight percent of magnesium;
at least 0.06 weight percent of boron, wherein the Ti/B ratio is in the range of 1 to 10;
zirconium, wherein the Zr/Ti ratio is in the range of 0.1 to 10;
less than about 0.001 weight percent of lithium; and
wherein the aluminum alloy comprises at least one of the following:
(a) at least about 0.01 and up to about 0.5 weight percent of scandium; or
(b) at least about 0.05 and up to about 1.2 weight percent of cobalt.

2. The aluminum alloy of claim 1, wherein the combined weight percent of the titanium, zirconium, and vanadium in the aluminum alloy is in the range of 0.18 to 1.5 weight percent.

3. The aluminum alloy of claim 1, wherein the aluminum alloy comprises silver.

4. The aluminum alloy of claim 1, wherein the aluminum alloy comprises manganese.

5. The aluminum alloy of claim 1, wherein the aluminum alloy comprises cobalt.

6. The aluminum alloy of claim 1, wherein the aluminum alloy comprises scandium.

7. The aluminum alloy of claim 1, wherein the aluminum comprises the majority of the weight percent of the alloy.

8. The aluminum alloy of claim 1, wherein the aluminum alloy is a wrought alloy.

9. An aerospace component comprising the aluminum alloy of claim 1.

10. The aluminum alloy of claim 1, wherein the Zr/Ti ratio is in the range of 0.1 to 4.

11. The aluminum alloy of claim 1, where the aluminum alloy is practically free of iron and/or silicon.

12. A wrought aluminum alloy, the aluminum alloy comprising:
at least about 40 and up to about 99 weight percent of aluminum;
at least about 3.5 and up to about 20 weight percent of copper;
at least 0.4 and up to about 10 weight percent of magnesium;
at least 0.06 and up to about 2 weight percent of boron;
at least 0.08 and up to about 1 weight percent of vanadium;
at least 0.5 and up to about 3 weight percent of zinc;
at least 0.25 and up to about 3 weight percent of titanium;
less than about 0.001 weight percent of lithium; and
wherein the aluminum alloy comprises at least one of the following:
(a) at least about 0.01 and up to about 0.5 weight percent of scandium; or
(b) at least about 0.05 and up to about 1.2 weight percent of cobalt.

13. The aluminum alloy of claim 12, wherein the aluminum alloy comprises:
at least about 0.2 and up to about 1 weight percent of manganese.

14. The aluminum alloy of claim 12, wherein the aluminum alloy comprises:
at least about 0.2 and up to about 1 weight percent of manganese;
at least about 0.1 and up to about 3 weight percent of zirconium; and
at least about 0.1 and up to about 1 weight percent of silver.

15. The aluminum alloy of claim 14, wherein the aluminum alloy comprises scandium.

16. The aluminum alloy of claim 14, wherein the aluminum alloy comprises cobalt.

17. The aluminum alloy of claim 12, wherein the aluminum alloy comprises:
an ultimate tensile strength at room temperature of at least about 65 and up to about 200 ksi as measured according to ASTM E8; and
an ultimate tensile strength at 500° F. of at least about 35 and up to about 150 ksi as measured according to ASTM E8.

18. The aluminum alloy of claim 12, wherein the aluminum alloy comprises:
an offset yield strength at room temperature of at least about 60 and up to about 200 ksi as measured according to ASTM E8; and
a percent elongation of at least about 2 and up to about 20 percent as measured according to ASTM E8.

19. An aerospace component comprising the aluminum alloy of claim 12.

20. The aluminum alloy of claim 12, wherein the aluminum alloy further comprises zirconium and titanium, wherein the Zr/Ti ratio is in the range of 0.1 to 4.

21. The aluminum alloy of claim 12, where the aluminum alloy is practically free of iron and/or silicon.

22. A method for producing an aluminum alloy, the method comprising:

(a) heat treating an initial aluminum alloy to thereby provide a heat-treated aluminum alloy;

(b) quenching the heat-treated aluminum alloy to thereby provide a quenched aluminum alloy;

(c) working the quenched aluminum alloy to thereby provide a worked aluminum alloy; and (d) aging the worked aluminum alloy to thereby provide the aluminum alloy, wherein the aluminum alloy comprises at least about 40 and up to about 99 weight percent of aluminum, at least about 3.5 and up to about 20 weight percent of copper, at least 0.4 and up to about 10 weight percent of magnesium, at least 0.06 and up to about 2 weight percent of boron, at least 0.08 and up to about 1 weight percent of vanadium, at least 0.5 and up to about 3 weight percent of zinc, at least 0.25 and up to about 3 weight percent of titanium, and less than about 0.001 weight percent of lithium;

wherein the aluminum alloy comprises at least one of the following:

(a) at least about 0.01 and up to about 0.5 weight percent of scandium; or (b) at least about 0.05 and up to about 1.2 weight percent of cobalt.

23. The method of claim 22, wherein the aluminum alloy comprises:

at least about 0.2 and up to about 1 weight percent of manganese;

at least about 0.1 and up to about 3 weight percent of zirconium; and at least about 0.1 and up to about 1 weight percent of silver.

24. The method of claim 23, wherein the aluminum alloy comprises at least about 0.01 and up to about 0.5 weight percent of scandium.

25. The method of claim 23, wherein the aluminum alloy comprises at least about 0.05 and up to about 1.2 weight percent of cobalt.

26. The method of claim 22, wherein the aluminum alloy comprises:

an ultimate tensile strength at room temperature of at least about 65 and up to about 200 ksi as measured according to ASTM E8; and an ultimate tensile strength at 500° F. of at least about 35 and up to about 150 ksi as measured according to ASTM E8.

* * * * *